US012172048B2

(12) United States Patent
Ringshall

(10) Patent No.: US 12,172,048 B2
(45) Date of Patent: Dec. 24, 2024

(54) ROPE EXERCISE SIMULATION DEVICE

(71) Applicant: Adam Ringshall, Greenhithe (GB)

(72) Inventor: Adam Ringshall, Greenhithe (GB)

( * ) Notice: Subject to any disclaimer, the term of this patent is extended or adjusted under 35 U.S.C. 154(b) by 0 days.

(21) Appl. No.: 18/272,587

(22) PCT Filed: Feb. 8, 2022

(86) PCT No.: PCT/IB2022/051098
§ 371 (c)(1),
(2) Date: Jul. 16, 2023

(87) PCT Pub. No.: WO2022/172148
PCT Pub. Date: Aug. 18, 2022

(65) Prior Publication Data

US 2024/0198171 A1 Jun. 20, 2024

(30) Foreign Application Priority Data

Feb. 12, 2021 (GB) ..... 2101973

(51) Int. Cl.
*A63B 21/00* (2006.01)
*A63B 21/005* (2006.01)
*A63B 21/062* (2006.01)

(52) U.S. Cl.
CPC ..... *A63B 21/4033* (2015.10); *A63B 21/0054* (2015.10); *A63B 21/0624* (2015.10); *A63B 2220/17* (2013.01); *A63B 2220/51* (2013.01); *A63B 2220/83* (2013.01)

(58) Field of Classification Search
CPC ..... A63B 21/0615; A63B 21/0616; A63B 21/0617; A63B 21/0618; A63B 21/0624; A63B 21/4019; A63B 21/4033; A63B 2220/17; A63B 2220/51; A63B 2220/83
See application file for complete search history.

(56) References Cited

U.S. PATENT DOCUMENTS 6,099,444 A * 8/2000 Domenge ..... A63B 21/0608 482/110
7,841,972 B1 * 11/2010 Huang ..... A63B 21/027 601/72
7,857,737 B1 * 12/2010 Ware ..... A63B 15/005 482/40
8,142,333 B2 * 3/2012 LaTour ..... A63B 5/20 482/8
2004/0087419 A1 * 5/2004 Ware ..... A63B 15/005 482/109

* cited by examiner

*Primary Examiner* — Zachary T Moore
(74) *Attorney, Agent, or Firm* — William H. Bollman

(57) ABSTRACT

A rope exercise simulation device comprises a handle and an elongate housing with at least one internally located displaceable weight. The housing extends substantially orthogonally with respect to an axis of the handle and the at least one weight is arranged to move between the ends of the housing acting against one or more resiliently deformable means.

27 Claims, 8 Drawing Sheets

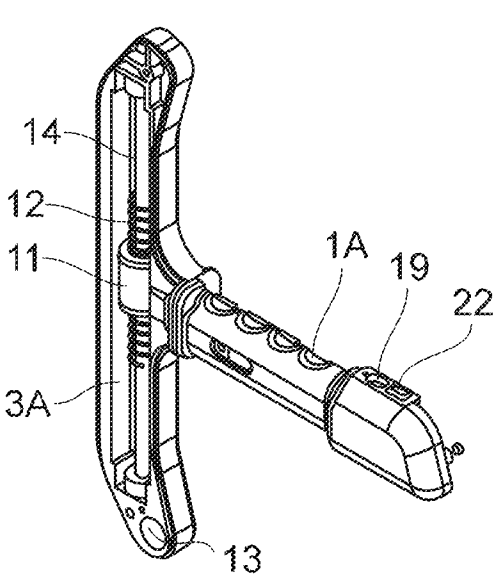
FIG. 1B
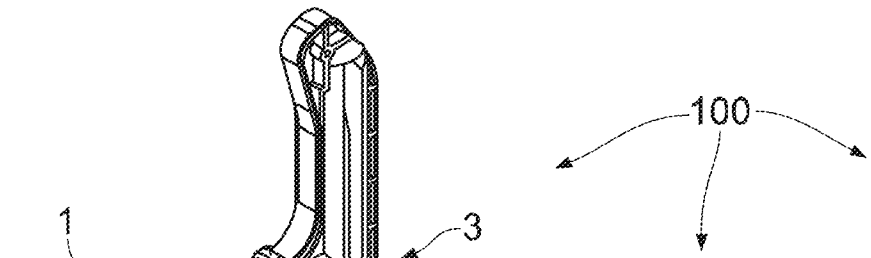
FIG. 1A
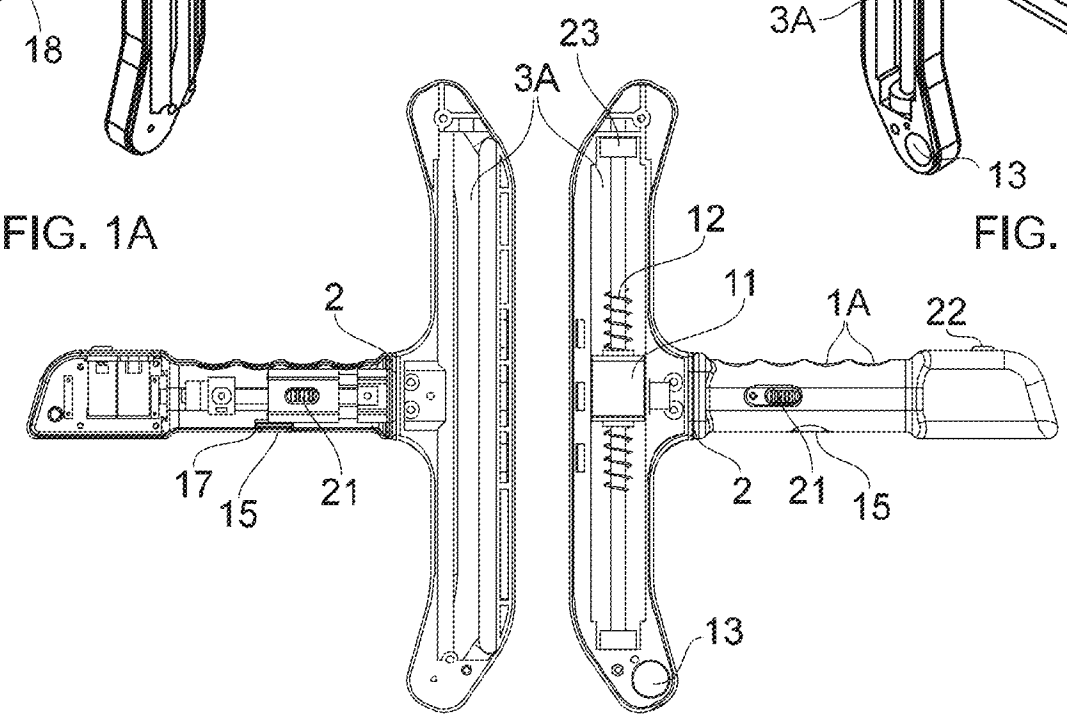
FIG. 1D
FIG. 1C

ROPE EXERCISE SIMULATION DEVICE

FIELD OF THE INVENTION

The present invention relates to a rope exercise simulation device for simulating training with a rope, in particular a pair of rope exercise simulation devices to simulate battle ropes.

BACKGROUND

Increasing awareness of the benefits and increased leisure time in many societies has led many users to exercise in a variety of different manners and regimes.

Of particular interest to many such people are battle ropes or fitness ropes and skipping exercises However such exercises typically require a large area of space and can easily interfere with the user's environs if they are not careful. Many users do not have a great deal of space in which to exercise and as such users will face limited movement options.

When using traditional ropes there is also no way to track, measure, record and therefore gauge progress, without manually recording the activity and duration.

The present invention arose in order to overcome problems suffered by existing devices.

PRIOR ART

CN 106 890 420 (HU) discloses an intelligent wireless skipping rope.

CN 103 386 190 (LIU) discloses a rope-free rope skipping device.

US 2010 0 125 026 (ZAVADSKY et al) discloses a wireless game controller.

DE202010007998U1 (UCHER HEALTH TECH CO LTD) discloses an exercise machine with a handle, an outer member and a weight member.

SUMMARY OF THE INVENTION

According to a first aspect of the present invention there is provided a rope exercise simulation device comprising: a handle and an elongate housing with at least one internally located displaceable weight; wherein the housing extends substantially orthogonally with respect to an axis of the handle and the at least one weight is arranged to move between the ends of the housing acting against one or more resiliently deformable means.

In this way a user can hold the handle and move the device in order to move the weight(s) back and forth along the elongate housing to generate forces that are received by the user through the handle. The device simulates the use of training with ropes, such as fitness ropes, battle ropes or a skipping rope, without the requirement for ropes. Advantageously this enables a user to train in a much smaller area and it is more practical for a training location, such as gym or at home, to have multiple training devices, as they take up much less space than sets of ropes.

Preferably the user may train with two rope exercise simulation devices, one held in each hand.

Preferably the handle is elongate so as to space the housing from the user and to allow a user to grip the handle with one hand, or if training with one device to allow a user to grip the handle with both hands. Ideally the handle has a substantially circular cross section to represent a rope.

In a preferred embodiment an outer surface of the handle may include raised and lowered portions to assist with gripping the handle. For example the handle may be shaped and dimensioned to provide finger grooves, or may have a textured surface, or the handle surface may recreate a rope surface to more closely simulate holding a rope.

In some embodiments the handle may have a cover, or be coated in material or fabric to assist with griping the handle. For example the handle may be wrapped in grip tape, such as the tape used on handles of racquets. In another embodiment the handle may include a resiliently deformable sleeve, such as sleeve formed from a cellular structure such as foam, or a rubber coating such as silicone. In this way the handle can be more easily and comfortably gripped during use.

The elongate housing defines a cavity within which one or more displaceable weight is arranged.

In a preferred embodiment the weight is slidable along a shaft mounted within the housing. The at least one internally located displaceable weight is arranged around, and is displaceable along the shaft. Ideally each weight is arranged on one or more bearing to enable smooth movement back and forth along the shaft.

In another embodiment the at least one weight is arranged to be displaceable in a tube so that the weight(s) can move linearly back and forth along the tube within the housing.

In yet a further embodiment two weights may be provided in two separate channels, one at each end of the housing. In this way the two weights move substantially simultaneously along each respective channel when a user moves the device.

Ideally the internally located displaceable weight(s) is arranged to move between the ends of the housing or ends of each channel, the weight acting against one or more resiliently deformable means when it engages with an end.

Preferably a resiliently deformable means is provided at each end of the cavity within the housing. In this way as the weight engages with the resiliently deformable means the weight is propelled back in the opposite direction until the weight engages with the opposing resiliently deformable means, or until a user ceases moving the device.

In some embodiments the resiliently deformable means may be associated with ends of the weight(s) so that the resiliently deformable means engages with the end instead of the weight. For example the resiliently deformable means may be connected to the weight.

Preferably the resiliently deformable means comprise one or more springs, such as coil springs that compress when the weight engages with the spring.

In this way the weight is bounced from end to end of the housing and movement is accelerated by both movement of the user and the one or more resiliently deformable means.

In some other embodiments the weights may be arranged to move between the ends of the housing between another resiliently deformable surface, such as a rubber pad.

In some embodiments the resiliently deformable means may be integrated with the weight. For example a spring may be embedded in the weight, or a rubber pad may be adhered to a first end and a second end of the weight, or a layer of resiliently deformable material may be arranged across ends of the cavity or tube through which the weight travels.

In yet a further embodiment a distal end of the resiliently deformable means that engages with the end of channel in the housing along which the weight travels may be arranged against a dampener arranged at the distal ends of the housing so as to protect the end of the housing and to limit jarring experienced by the user and to instead encourage a continuous oscillating movement. For example the dampener may be form from a cellular structure such as foam.

In another embodiment the weight(s) has a circular cross section in order to be received by and to travel along the tube, or through a substantially tubular cavity.

In yet a further embodiment the device may have two weights, each moveable within its own channel. For example a shaft may be arranged through a central block. A weight is arranged on the shaft either side of the block so that the block limits travel of each weight. Both weights are able to move as a user moves the device. This configuration means that each weight may have a smaller distance to travel. It is appreciated that in preferred embodiments each weight arranged on a shaft includes at least one bearing to permit smooth movement back and forth along the shaft.

In some embodiments the housing may be movable with respect to the handle. For example in some embodiments the housing may be arranged to rotate on the handle by means of a rotating joint. In this way whilst the handle is held, the housing and thereby the weights may spin about an axis in response to movement of a user.

This increases the strength and stability required by the user, and thus increases the range of exercises that can be performed and muscle engagement that can be achieved. Preferably the housing is able to rotate clockwise and anti-clockwise.

Ideally a locking mechanism is provided to prevent rotation of the housing on the handle, so that a user can select when to enable this function.

In some embodiments the rotating joint may be provided with a control dial that adjusts ease of rotation and may also lock the rotating joint. In this way a user can change the ease of rotation so that more or less force must be applied by a user in order to spin the housing with respect to the handle.

In some embodiments the device has a plurality of sensors to measure different parameters. The sensors may be used to monitor movement of all or part of the device, such as the orientation of the device and/or track movement of the one or more weights. The sensors may also be used to detect status of a user, for example to monitor a user's heartrate. Some examples of the sensors that may be provided on the device include:

- a heartrate sensor arranged on the handle to monitor user heartrate through skin contact, such as a thumb pressed against a sensor surface
- a blood oxygen sensor arranged on the handle to monitor oxygen saturation through skin contact of the hand around the handle
- an acceleration sensor or gyroscope to detect movement and frequency of movement of the device and or weights in the housing It is appreciated that in some embodiments the sensor(s) may be located on the handle to indicate the preferred holding locations so that a user is required to hold the handle in a preferred position so as to contact the sensor(s). In this way the sensor or sensors may be arranged to allow a user to monitor progress and/or their status, such as vital statistics during exercise.

In preferred embodiments the one or more sensor is in communication with a processor. The processor is operative to receive signals from the at least one sensor and to process the signals and output a signal. For example the output signal may be indicative of number of exercise cycles ('reps') and/or magnitude of force exerted in an exercise cycle.

Preferably the processor is a microprocessor that is arranged on a printed circuit board (PBC) within the housing.

The processor allows signals collected from the one or more sensors to be analysed. For example the processor may monitor and record the number of times each sensor is activated, so that repetition of movements can be monitored and recorded.

In some embodiments data from the sensor(s) may be analysed by a remote processor, or data from a first processor on the device is transmitted to a second remote processor. For example the device may include a transmitter to send sensor signals, or data from the first processor to a remote device such as smartphone or personal computer that has computer implemented software to analyse the data received. Preferably the computer implemented software enables the data received to be presented visually, for example in a graphical form so that a user can track their activity and/or track their status. For example rate of weight oscillations over time may be plotted on a graph to show if a user is consistently maintaining the same level of output.

In a preferred embodiment the transmitter may use Bluetooth® to wirelessly send and receive signals/data. Ideally the device may include a switch to enable the transmitter to be turned on an off.

In this way the processor can analyse received data from the sensors on the device and the data collected may be used to determine when certain conditions are met, for example to indicate when the device is being used effectively, to warn of incorrect use and/or to monitor parameters of the user. For example the sensors may measure movement of the weights and/or impact of the weights against the resiliently deformable means and this data can be analysed to determine if there is regular spring oscillation and to determine the force applied by a user.

The processor may also be used for comparing data collected from the sensors, or comparing data from the sensors with a database. For example the processor may compare a current heartrate value with an expected or known maximum heartrate value, prompting a user to accelerate movement frequency to a safe level when the current heartrate is not in line with a predetermined expected rate, or within a preferred training heartrate training zone.

In some embodiments the device may comprise a feedback means, for example to alert a user when a preset condition is met. The feedback means may comprise an alert means such as visual, audible or haptic feedback means which provides an alert to a user when certain conditions are met.

In a preferred embodiment the alert means may be activated upon receipt of a processed signal from the at least one sensor. For example a visual alert such as a flashing light, or an audible alert such as a beep, may be triggered when optimal oscillation of the weight is detected, or when a predetermined level of force is detected.

In this way it may be envisaged that in some embodiments an alert means, such as a light source may be used to communicate feedback to a user, such as flashing light to indicate a requirement for greater frequency of movement.

In some embodiments the device may include a timer to enable exercise duration to be measured. The timer may be associated with an alert, such as audible alert so that a sound is generated to indicate to a user when a pre-determined time period has been reached, therefore allowing the user to easily train for set periods of time.

In some embodiments transmitted signals from a pair of devices, one held in each hand are processed simultaneously to obtain a score indicative of equal exercise input to each rope exercise simulation device.

In another embodiment transmitted signals from two or more devices held by two or more users are processed simultaneously to obtain individual scores indicative of at least one preset parameter, or an optimal level or a time period. In this way a group of users can compare their exercises to confirm if they have been performed correctly and effectively. The score may also be used to benchmark a user against others and/or for competition purposes, for example to determine a user with greatest fitness, most endurance, best technique.

For devices including one or more sensor the device has at least one battery. The battery may be disposable and/or rechargeable.

In a preferred embodiment the device may include a rechargeable lithium ion battery and provision may be made for the battery to be recharged in situ, for example by means of a charging port or adapted for inductive charging. An alert such as a light may be provided on the device to indicate charge status and to indicate status of the one or more battery.

In some embodiments it may be envisaged that an energy generation means may be provided to charge the one or more rechargeable battery. For example the device may include a piezo-electric transducer or other motion energy harvesting mechanism. In some embodiments the device may comprise one or more photovoltaic cell for use as an energy harvesting mechanism.

In some embodiments the device may include a memory connected to the processor so that it is possible to allow download or upload of data or software, through a wireless connector or through a wired connection. In this way the user may be enabled to remotely store their progress or to upload historic data to be compared against a new workout.

In some embodiments the handle and/or the housing include a counterweight.

In some embodiments a counterweight may be provided in the handle to balance the weight within the housing, therefore making it easier for a user to hold the device and maintain grip during repeated movement.

In some embodiments a counterweight is provided at one end of the housing. In this way the weight distribution of the housing is biased. This configuration will help maintain spinning momentum of the housing with respect to the handle and will also assist the user to hold the device in a particular orientation as the counterweight will most easily be held at the lowest position.

A preferred embodiment of the invention will now be described by way of example only and with reference to the Figures in which:

BRIEF DESCRIPTION OF FIGURES

FIGS. 1A and 1C show a show side views of an outer surface of a first embodiment of the device with the outer casing removed from the handle and the housing in which the shaft and weight are beneath the internal casing;

FIGS. 1B and 1D show the opposite side of the first embodiment shown in FIGS. 1A and 1C revealing the inner surface so that the weight and shaft are visible, with the outer casing removed from the housing, and the outer casing included on the handle;

DETAILED DESCRIPTION OF FIGURES

Figure 2:
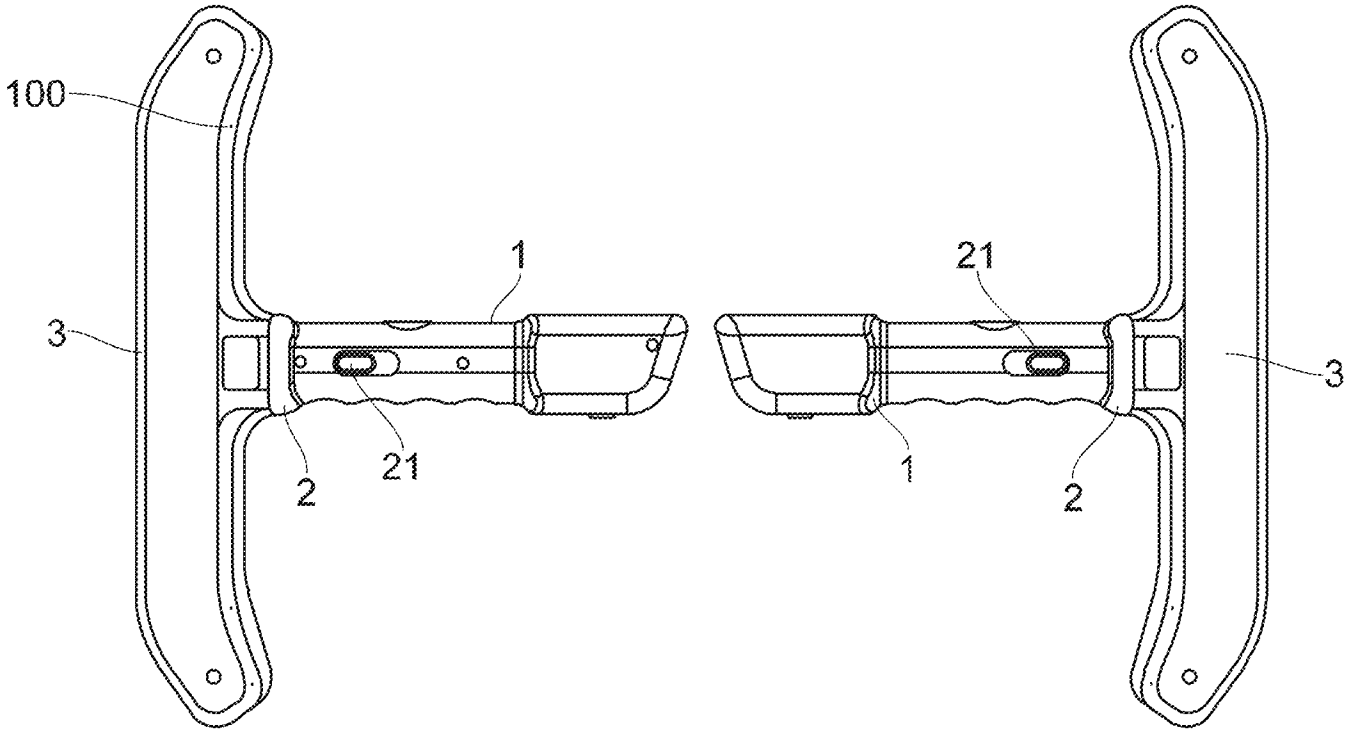
FIG. 2 shows a pair of the first embodiment devices with the outer casing in place.

With reference to the figures there is shown three embodiments of the rope exercise simulation device 100, 200, 300. Like parts have the same reference numbers.

The rope exercise simulation devices 100, 200, 300 all have an elongate handle 1 that is grasped by a user during use and a housing 3 extending orthogonally from the handle 1.

The housing 3 houses a mechanism that simulates a rope being suspended from the handle, so that the exercise device 100, 200, 300 can be used to simulate training with battle ropes.

The housing 3 is substantially elongate and linear, defining an axis that is perpendicular to the axis defined by the handle 1.

The mechanism provided within the housing 3 is at least one weight 11 that is able to move back and forth along a cavity 3A within the housing 3 in response the movement of the device 100, 200, 300 by a user (not shown).

In the first embodiment 100 a single weight 11 is arranged on a shaft 14. Each weight 11 arranged on the shaft 14 includes at least one bearing (not shown) to permit smooth movement back and forth along the shaft 14.

The resilient means is a coil spring 12 arranged either side of the weight 11. The weight 11 can move back and forth along the shaft 14 so that the coil springs 12 engage alternatively with each end of the cavity 3A. At each end of the shaft 14 is a stopper 23 that receives the springs 12. The stopper 23 is intended to prevent damage to the ends of the housing and in some embodiments may act as a dampener.

The housing 3 is rotatable with respect to the handle 1 about a rotating joint 2. The rotation can be locked by a switch 21 that activates a locking mechanism to prevent rotation.

In the second embodiment 200 shown in FIGS. 3 to 7, the housing 3 defines a cavity 3A and within the cavity 3A defined by the housing 3 there is provided an elongate cylindrical weight 11, which slides along an elongate cylindrical tube 14 when the device 200 is moved by a user.

The weight 11 is located between a pair of compression springs, one arrange either side of the sliding weight within the tube 14. The weight 11 thereby acts against the compression springs 12 located at either end of the tube 14 to force the weight 11 between the springs 12 when the device is moved by a user.

In the third embodiment 300 shown in FIG. 8 the housing 3 is not shown, only the internal components are shown.

Figure 8B:
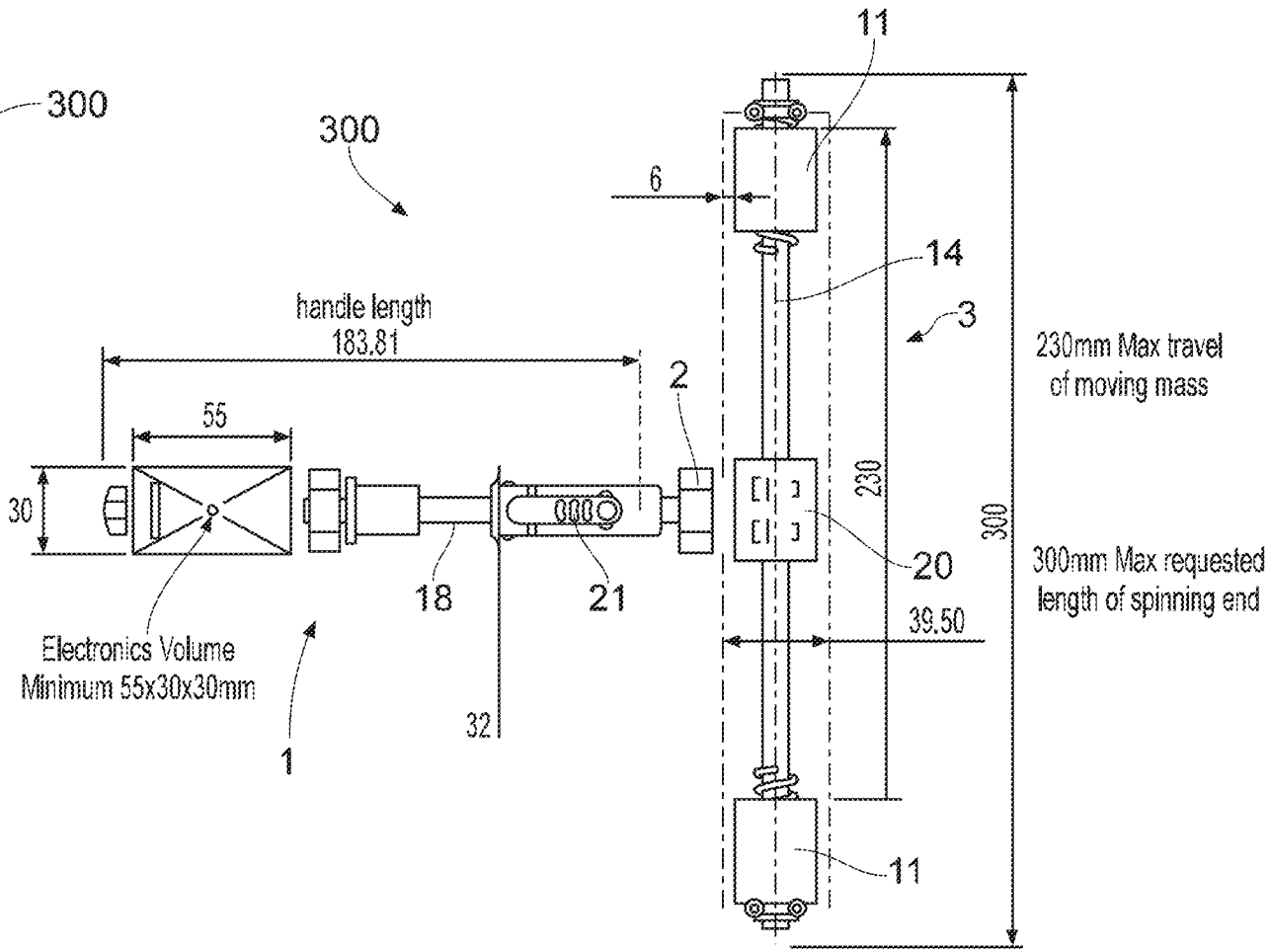
FIG. 8B shows an exploded view of the internal components of the third embodiment of the rope exercise simulation device.
Figure 8A:
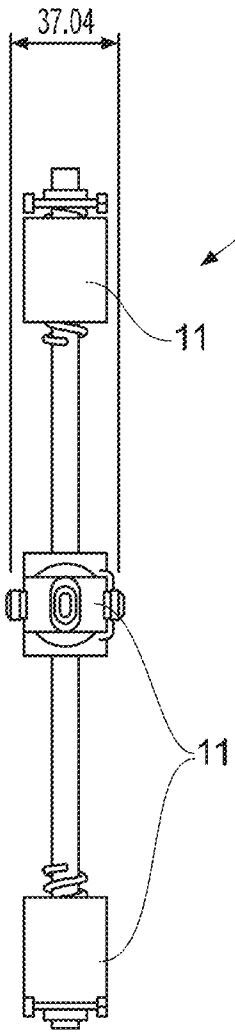
FIG. 8A shows an end view of the internal components of a third embodiment of the rope exercise simulation device.

In the third embodiment the coil spring 12 is shown embedded within the weight 11. The coil spring 12 extends from both sides of the weight 11. The weight has bearings that engage with the shaft for smooth movement of the weight along the shaft 14. In FIGS. 8A and 8B the weight is shown at three positions, the first end, the middle and the second end.

Some preferred dimensions are shown in FIGS. 8A and 8B, but it is appreciated that embodiments may have different dimensions.

In preferred embodiments the range of travel of the weight or weights is at least 200 mm and ideally at least 300 mm.

The housing 3 of each device 100, 200, 300 is arranged to rotate on the handle 1 by means of a rotating joint 2. In this way whilst the handle is held, the housing and thereby the weights may spin about an axis in response to movement of a user.

The handle 1 of first and second embodiments of the device 100, 200 has a skin contact sensor 15 for measuring a parameter of the user. For example to measure heartrate when a user's palm and/or fingers or thumb are placed over the sensor surface 15.

The handle of the second embodiment has a transceiver 17 that is arranged within the handle. The transceiver 17 enables signals from the sensor 15 to be transmitted to a remote processor (not shown). The transceiver 17 is also able to receive signals from the remote processor (not shown).

In the second embodiment 200 the sensors are associated with a plate 15 forming an external contact surface, which is located on the handle 1 on an upper face of the handle, near to the housing 3, such that in use the user's hand (not shown) is located over the plate 15 of the sensors, providing skin contact therefor.

The handle 1 connects to the housing 3 by means of a rotating joint 2. In this way the housing 3 can spin about the joint as the user moves the device 100, 200, 300.

This enables the housing 3 to be rotated around the rotating joint 2, so that the housing 3 spins in an axis that is perpendicular to the axis of the handle 1. In this way a variety of different exercises may be accommodated, and the ends and internal weight are moved by a repeated action carried out by the user.

The rotatable joint 2 shown in the second embodiment (FIGS. 3 to 7) includes a dial around the rotating joint 2. A user can select ease of rotation using the dial and the dial may also be used to prevent rotation.

In the first and third embodiments 100, 300 there is a switch 21 that is associated with a lock mechanism that locks rotation of the housing 3 with respect to the handle 1.

In the second embodiment, the handle 1 internally includes a second spring 16 arranged to maintain the mechanism engaged at the mechanism end when rotated. The spring 16 permits moment between the handle and housing and will act to soften the movement of the housing with respect to the handle, therefore making it more comfortable for a user to hold for prolonged periods of time.

In the first embodiment 100 a counterweight 13 is provided at one end of the housing 3. In this way the weight distribution of the housing 3 is biased. This configuration will help maintain spinning momentum of the housing 3 with respect to the handle 1 about the rotating joint 2, and will also assist the user to hold the device in a particular orientation as the counterweight 13 will most easily be held at the lowest position.

In the second embodiment 200, a distal end of the handle 1 has an internally located counterweight 13. The counterweight 13 helps to balance against the weight of the housing 3 and provides greater simulation of training with ropes.

In all three embodiments, the handle 1 includes a core rod 18 for structure strength. Preferably the rod 18 is formed from steel or stainless steel to provide weight and structural strength.

In the first and second embodiments 100, 200 the handle 1 is shown with a sensor surface 15 that is operatively connected to a printed circuit board (PCB) 17 and at least one battery (not shown).

The battery (not shown) is rechargeable and may be recharged using a socket 19 on the handle 1 (see the first and second embodiments).

In the first embodiment the socket 19 is at a distal end of the handle 1 adjacent to a button 22 that is provided to turn on and off the Bluetooth® module.

In the second embodiment the socket 19 is shown extending to the opposing face of the handle 1 to the sensor plate 15.

The first embodiment 100 shown in FIGS. 1 and 2 has a handle 1 that is shaped and dimensioned to correspond to the fingers of a user having finger grips 1A.

Figure 3:
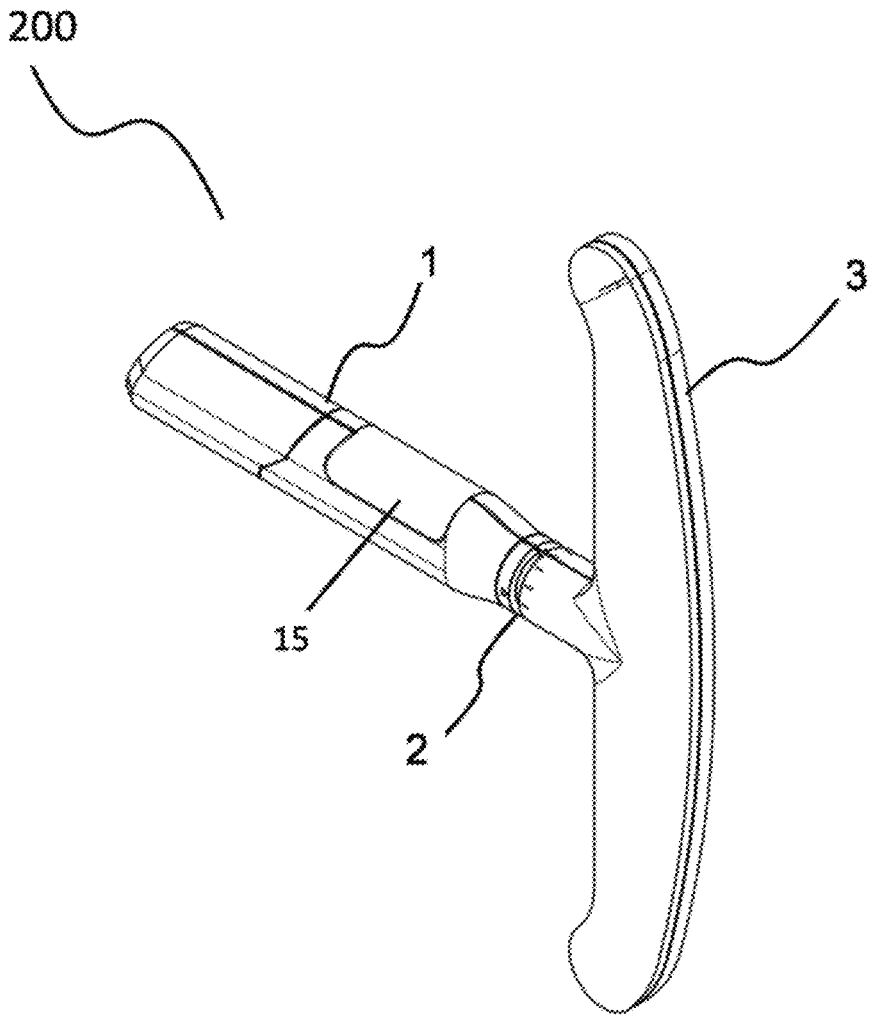
FIG. 3 shows an isometric view of a second embodiment of the rope exercise simulation device.
Figure 4:
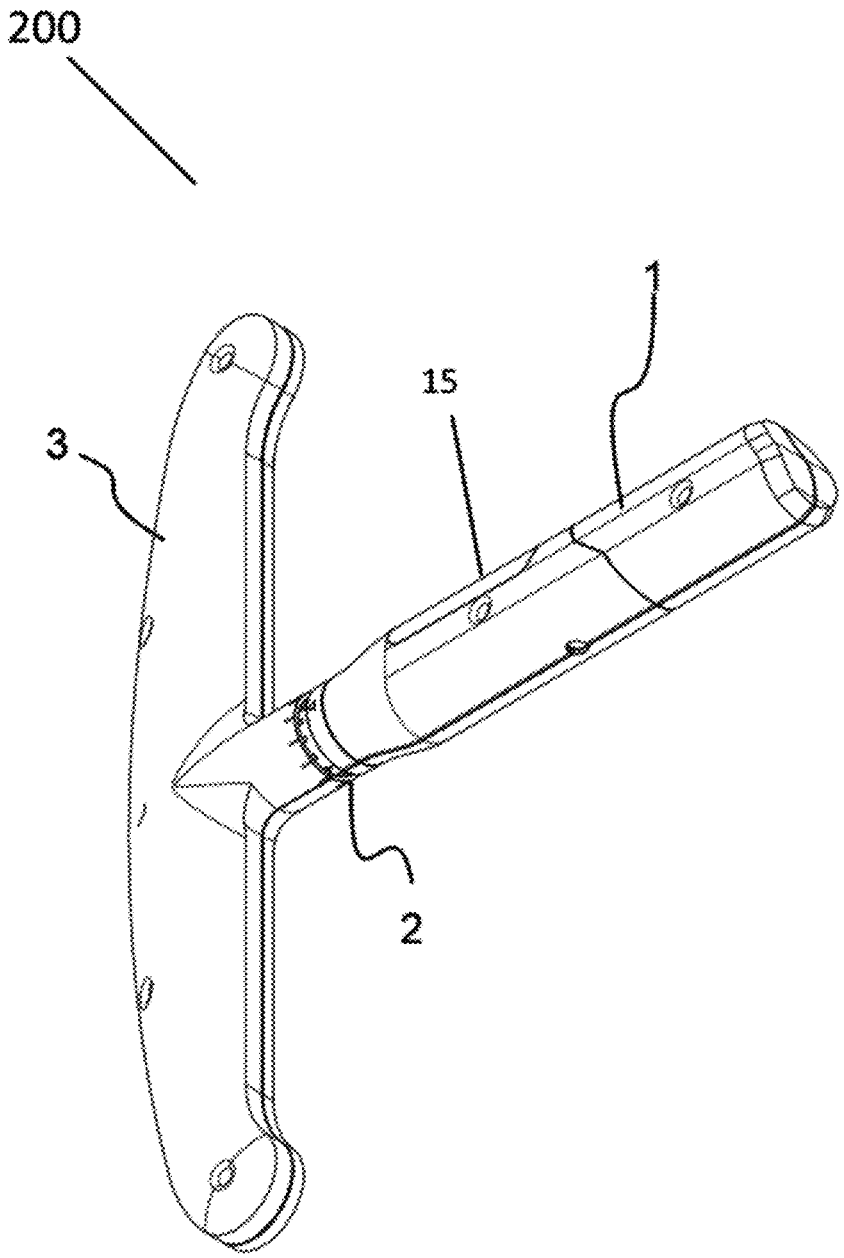
FIG. 4 shows a reverse isometric view of the second embodiment of the rope exercise simulation device.
Figure 5:
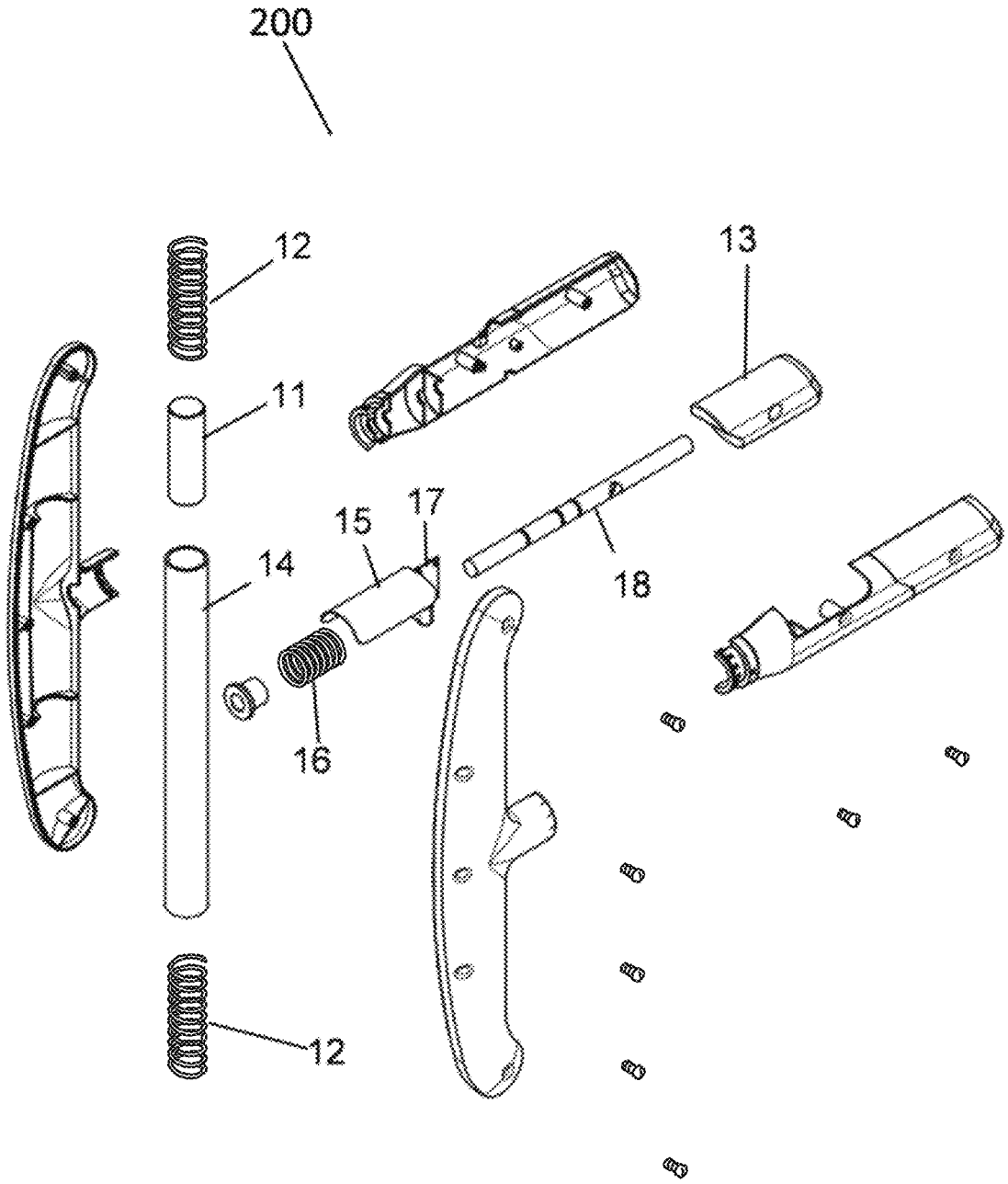
FIG. 5 shows an exploded isometric view of the second embodiment of the rope exercise simulation device.
Figure 6:
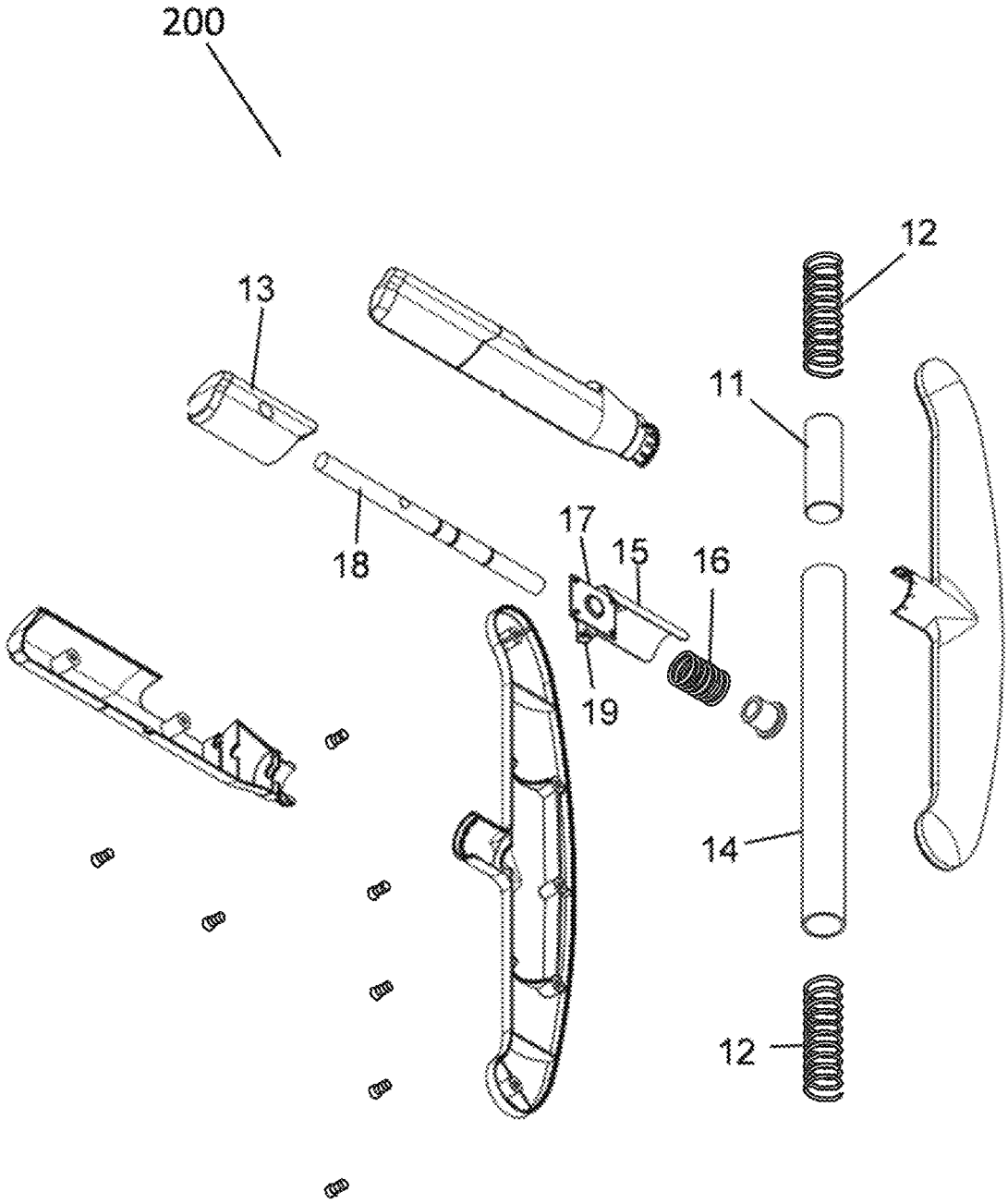
FIG. 6 shows a reverse exploded isometric view of the second embodiment of the rope exercise simulation device.
Figure 7:
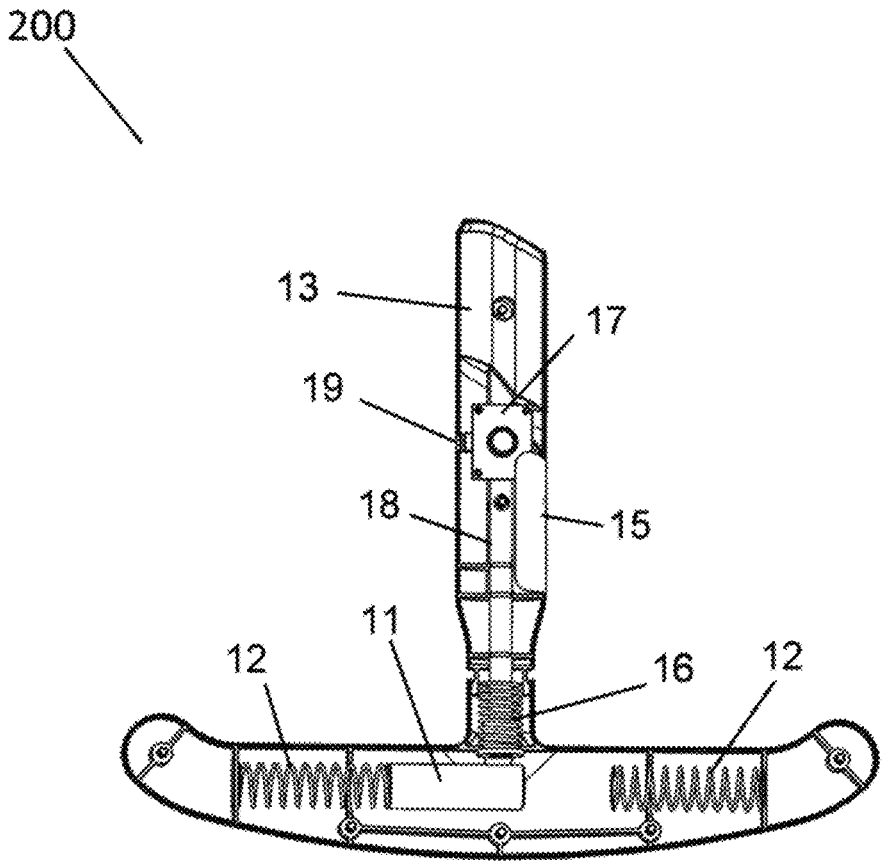
FIG. 7 shows a sectional view of the second embodiment of the rope exercise simulation device.

All embodiments have a substantially smooth outer casing that encloses or provides a mounting for all components and ensures the devices are comfortable and safe to hold. The outer casing of the housing and handle are best shown in FIGS. 2, 3 and 4.

The outer casing of the housing 3 shown in the first and second embodiments 100, 200, has returned distal ends to provide curved ends directed towards a user when held by the handle 1. This shaping assists with a repeated up and down motion carried out by a user.

The invention has been described by way of examples only and it will be appreciated that variation may be made to the above-mentioned embodiments without departing from the scope of protection as defined by the claims.

The invention claimed is:

1. A rope exercise simulation device comprising:

a handle and an elongate housing with at least one internally located displaceable weight, the housing extends substantially orthogonally with respect to an axis of the handle; and the at least one internally located displaceable weight moving between ends of the housing act against one or more resiliently deformable means; wherein the elongate housing is rotatable with respect to an axis of the handle by means of a rotating joint; and a locking mechanism is provided to selectively lock the elongate housing and the handle to prevent relative rotation of the handle and elongate housing.

2. The rope exercise simulation device according to claim 1 wherein the at least one internally located displaceable weight is arranged around, and is displaceable along, a shaft.

3. The rope exercise simulation device according to claim 2 wherein the at least one internally located displaceable weight includes at least one bearing that engages with the shaft.

4. The rope exercise simulation device according to claim 1 wherein the at least one internally displaceable weight is displaceable within a tube.

5. The rope exercise simulation device according to claim 1 wherein the resiliently deformable means is at least one spring.

6. The rope exercise simulation device according to claim 1 wherein the resiliently deformable means is at least one resiliently deformable pad.

7. The rope exercise simulation device according to claim 1 wherein a cross section of the handle is substantially circular.

8. The rope exercise simulation device according to claim 1 includes at least one sensor to detect movement of the device or part of the rope exercise simulation device.

9. The rope exercise simulation device according to claim 8 wherein the at least one sensor tracks movement of the at least one internally located displaceable weight.

10. The rope exercise simulation device according to claim 8 wherein the at least one sensor is an accelerometer.

11. The rope exercise simulation device according to claim 8 wherein the at least one sensor is a gyroscopic sensor.

12. The rope exercise simulation device according to claim 8 includes a processor which is operative to receive signals from the at least one sensor and to process the signals and output a signal indicative of number of exercise cycles ('reps') and/or magnitude of force exerted in an exercise cycle.

13. The rope exercise simulation device according to claim 12 wherein the processor is located in the handle.

14. The rope exercise simulation device according to claim 8 including a transmitter to transmit signals from the at least one sensor to a remote receiver.

15. The rope exercise simulation device according to claim 8 includes an alert means that is activated upon receipt of a processed signal from the at least one sensor.

16. The rope exercise simulation device according to claim 8 including at least one battery.

17. The rope exercise simulation device according to claim 16 including an energy harvesting mechanism to charge the at least one battery.

18. The rope exercise simulation device according to claim 8 with a processor operable with computer implemented software to analyse signals received from the at least one sensor.

19. The rope exercise simulation device according to claim 1 including at least one sensor arranged on the handle to sense a user status of a user holding the handle.

20. The rope exercise simulation device according to claim 19 wherein the at least one sensor is a skin contact sensor.

21. The rope exercise simulation device according to claim 20 wherein the skin contact sensor is a heartrate sensor.

22. The rope exercise simulation device according to claim 1 wherein the handle includes a counterweight.

23. The rope exercise simulation device according to claim 1 wherein the housing includes at least one counterweight.

24. The rope exercise simulation device according to claim 1 wherein distal ends of the housing are returned so as to be directed towards a user when held by the handle.

25. A training apparatus comprising two of the rope exercise devices according to claim 1.

26. The rope exercise simulation device according to claim 1, further comprising:

at least one sensor to detect movement of the device or part of the rope exercise simulation device;

a transmitter to transmit signals from the at least one sensor to a remote receiver; and a processor operable with computer implemented software to analyse signals received from the at least one sensor, wherein transmitted signals are processed simultaneously to obtain a score indicative of equal exercise input to each rope exercise simulation device.

27. The rope exercise simulation device according to claim 1, further comprising:

at least one sensor to detect movement of the device or part of the rope exercise simulation device; and transmitter to transmit signals from the at least one sensor to a remote receiver, wherein transmitted signals from two or more devices held by two or more users are processed simultaneously to obtain individual scores indicative of at least one preset parameter, or an optimal level or a time period.

* * * * *